US008373360B2

(12) United States Patent
Leung et al.

(10) Patent No.: US 8,373,360 B2
(45) Date of Patent: Feb. 12, 2013

(54) LIGHTING CONTROL SYSTEM AND LED LAMP

(75) Inventors: Chun Kai Leung, Shatin (HK); Kai Chiu Wu, Shatin (HK); Tik Shun Leung, Shatin (HK); Kin Cheong Li, Shatin (HK); Ming Lu, Shatin (HK)

(73) Assignee: Hong Kong Applied Science and Technology Research Institute Co. Ltd., Hong Kong (CN)

( * ) Notice: Subject to any disclaimer, the term of this patent is extended or adjusted under 35 U.S.C. 154(b) by 630 days.

(21) Appl. No.: 12/551,880

(22) Filed: Sep. 1, 2009

(65) Prior Publication Data

US 2011/0050120 A1 Mar. 3, 2011

(51) Int. Cl.
*H05B 37/02* (2006.01)

(52) U.S. Cl. ..... 315/294; 315/32; 315/184

(58) Field of Classification Search ..... 315/291, 315/32, 51, 184; 439/151–153
See application file for complete search history.

(56) References Cited

U.S. PATENT DOCUMENTS

| | | | | |
|---|---|---|---|---|
| 5,008,595 | A * | 4/1991 | Kazar | 315/178 |
| 5,404,282 | A * | 4/1995 | Klinke et al. | 362/249.06 |
| 6,657,381 | B1 * | 12/2003 | Arutaki | 313/512 |
| 7,114,841 | B2 * | 10/2006 | Aanegola et al. | 362/640 |
| 7,399,105 | B2 * | 7/2008 | Southard et al. | 362/391 |
| 7,959,325 | B2 * | 6/2011 | Roberts et al. | 362/249.02 |

* cited by examiner

*Primary Examiner* — James H Cho
(74) *Attorney, Agent, or Firm* — Brooks Kushman P.C.

(57) ABSTRACT

A lighting control system and an LED lamp for use with the lighting control system are provided. In one embodiment, the LED lamp includes a color LED including a red LED, a green LED, and a blue LED, and a lamp contact having a first contact section, a second contact section, and a third contact section, each of the first contact section, the second contact section, and the third contact section including a positive contact and a negative contact, wherein the first contact section is electrically connected to the red LED, the second contact section is electrically connected to the green LED, and the third contact section is electrically connected to the blue LED. The lighting control system may include an LED driver unit configured to provide independent electrical connection with each of the contact sections of the LED lamp.

17 Claims, 13 Drawing Sheets

Lamp Checking Logic Table

| CTL input | Lamp Checking Device 1 | Lamp Checking Device 2 | Status |
|---|---|---|---|
| CTL1=1 , CTL2=0 | 1 | 1 | No lamp |
| CTL1=1 , CTL2=0 | 0 | 0 | Lamp is found. White Light with conventional pin |
| CTL1=1 , CTL2=0 | 0 | 1 | Lamp is found. Lamp with proposed pin |

Lamp Checking Logic Table

| CTL input | Lamp Checking Device 1 | Lamp Checking Device 2 | Status |
|---|---|---|---|
| CTL1=1 , CTL2=1 | 0 | 1 | Lamp is found. Lamp with proposed pin. 2 segments used (2 colors) |
| CTL1=1 , CTL2=1 | 0 | 0 | Lamp is found. Lamp with proposed pin. 3 segments used (3 colors) |

FIG. 13

LIGHTING CONTROL SYSTEM AND LED LAMP

FIELD OF THE INVENTION

The present invention relates to a lighting control system, and more particularly, to a lighting control system and an LED lamp for use with the lighting control system.

BACKGROUND OF THE INVENTION

Light emitting diode (LED) technology is currently one of the most innovative and fastest growing in the lighting industry. While LED have been in use for decades for indicator and signaling purposes, technology developments and improvements have allowed for a broader use. The use of LED in lighting applications has grown especially rapidly in recent years.

The use of LED in lighting applications is attractive for a number of reasons, including the ability to provide higher levels of illumination, a longer life cycle, minimum maintenance requirements, energy efficient, and flexibility in terms of coloring and beam control. Currently, there are a number of control systems that control the level of the lighting luminaries. However, lighting with control capabilities typically requires specially designed lamps with internal control systems located on each individual lamp. Because of the internal control systems required on each lamp, such controllable lighting systems are costly and impractical in many lighting situations.

Accordingly, there is a need for a wireless lighting control system and an LED lamp that addresses these and other shortcomings of LED lighting.

SUMMARY OF THE INVENTION

According to one embodiment of the present invention, a controllable color light emitting diode (LED) lamp is disclosed. The controllable color LED lamp includes two or more light emitting elements, a first light emitting element of the two or more light emitting elements configured to emit a first light spectrum and a second light emitting element of the two or more light emitting elements configured to emit a second light spectrum, each of the two or more light emitting elements including an anode and a cathode; and a positive electrical contact and a negative electrical contact, each of the positive electrical contact and the negative electrical contact including at least a first contact section and a second contact section, each of the first contact sections and the second contact sections separated by insulating material, wherein the first contact section of the positive electrical contact is electrically connected to the anode of the first light emitting element and the second contact section of the positive electrical contact is electrically connected to the anode of the second light emitting element, and wherein the first contact section of the negative electrical contact is electrically connected to the cathode of the first light emitting element and the second contact section of the negative electrical contact is electrically connected to the cathode of the second light emitting element.

According to another embodiment of the present invention, a lighting control system is disclosed. The lighting control system includes a control unit configured to receive lighting control instructions and transmit lighting control signals to one or more light emitting diode (LED) lamps; and an LED driver unit configured to provide electric control of one or more LED lamps, the LED driver unit including one or more LED drivers, each of the one or more LED drivers configured to deliver one or more independent light control signals, the LED driver unit further including one or more detection devices configured to detect the presence of a controllable LED lamp electrically coupled to the lighting control system.

Still other embodiments of the present invention will become readily apparent to those skilled in the art from the following detailed description, wherein embodiments of the invention are described by way of illustration. As will be realized, the invention is capable of other and different embodiments and its several details are capable of modifications in various respects, all without departing from the spirit and the scope of the present invention.

BRIEF DESCRIPTION OF THE DRAWINGS

FIG. 13 is a logic table illustrating decision logic for the lamp type detection system illustrated in FIGS. 11 and 12, in accordance with a second embodiment of the present invention.

DETAILED DESCRIPTION

In the following description, reference is made to the accompanying drawings where, by way of illustration, specific embodiments of the invention are shown. It is to be understood that other embodiments may be used as structural and other changes may be made without departing from the scope of the present invention. Also, the various embodiments and aspects from each of the various embodiments may be used in any suitable combinations. Accordingly, the drawings and detailed description are to be regarded as illustrative in nature and not as restrictive.

Generally, embodiments of the present invention are directed to a lighting control system including multiple color light emitting diode (LED) lamps and an external control system configured to control the multiple color LED lamps. According to one embodiment, the LED lamps three different spectrum LEDs, and the control system is configured to transmit three control signals for controlling the color of one or more LED lamps, as well as the light intensity. Embodiments of the control system provide an external control system where the main control circuitry is external from the individual lamps used with the system. Since embodiments of the present invention may use external control circuitry, each of the lamps configured for use with the control system may omit control circuitry, or included a reduced amount control circuitry, thereby reducing the individual cost of each lamp.

Figure 1:
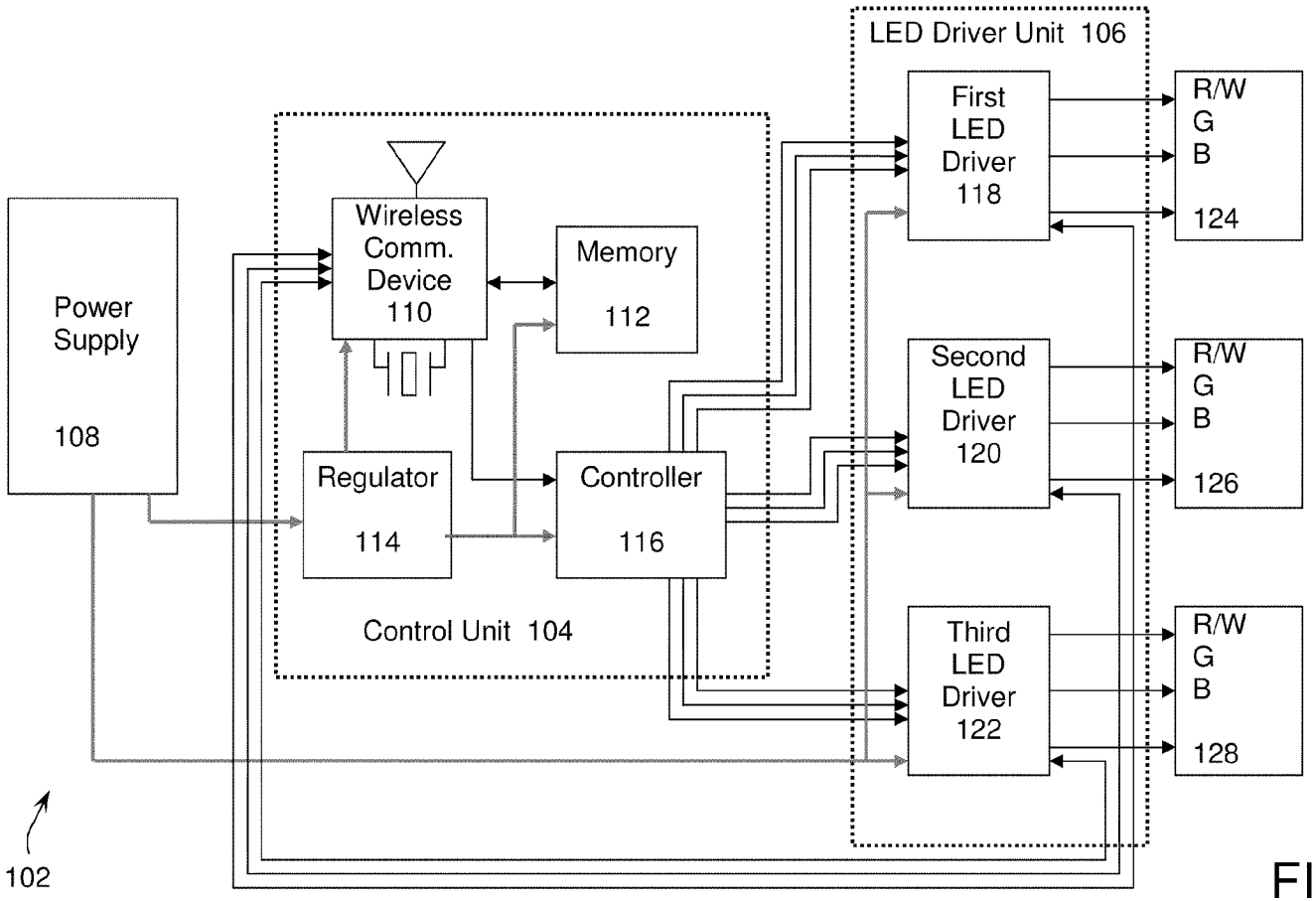
FIG. 1 is a block diagram of a lighting control system and apparatus, in accordance with an embodiment of the present invention.

FIG. 1 is a block diagram of a lighting control system and apparatus, in accordance with an embodiment of the present invention. The lighting control system 102 includes a control unit 104 and an LED driver unit 106. A power supply unit 108 provides power to the control unit 104 and the LED driver unit 106. The control unit 104 includes a wireless communication device 110, a memory 112, a regulator 114, and a controller 116. The wireless communication device 110 may be any suitable wireless transfer capable transferring and receiving wireless communication. One example device suitable as a wireless communication device 110 is available under the commercial name Zigbee. However, any suitable wireless communications device may be used. In one embodiment, the wireless communication device 110 is configured to receive lighting control instruction from a user of the lighting control system 110 and transmit the lighting control instructions to the controller, which then makes adjustments to LED lamps that are electrically coupled to the system 102. The LED driver unit 106 includes a first LED driver 118, a second LED driver 120, and a third LED driver 122. The first LED driver is coupled to a first lamp socket 124, the second LED driver 120 is coupled to a second lamp socket 126, and the third LED driver 122 is coupled to a third lamp socket 128. In one embodiment, the first LED driver 118, the second LED driver 120 and the third LED driver 122 are coupled with the first lamp socket 124, the second lamp socket 126, and the third lamp socket 128, respectively, by an electrical connection.

The memory 112 of the control unit 104 is any suitable non-volatile, such EEPROM or other type of non-volatile memory, such as flash memory. The regulator 114 is configured to deliver electric power to the control unit 104. The controller 116 to deliver control signals to each of the first LED driver 118, the second LED driver 120, and the third LED driver 122.

The control system is configured to send multiple control signals to a color LED lamp using multiple control signal channels, each control signal channel corresponding to each of the colors of the LED lamp. Each LED lamp may include a conventional two-pin connection that is configured to include multiple sections for receiving multiple control signals. The positive pin and the negative pin each may include multiple sections for receiving positive and negative control signals corresponding to each of the colors of the LED lamp. The control signal can control the intensity of each LED individually, thereby providing control over the color of the LED lamp and the intensity of the light emitted by the LED lamp.

Figure 2A:
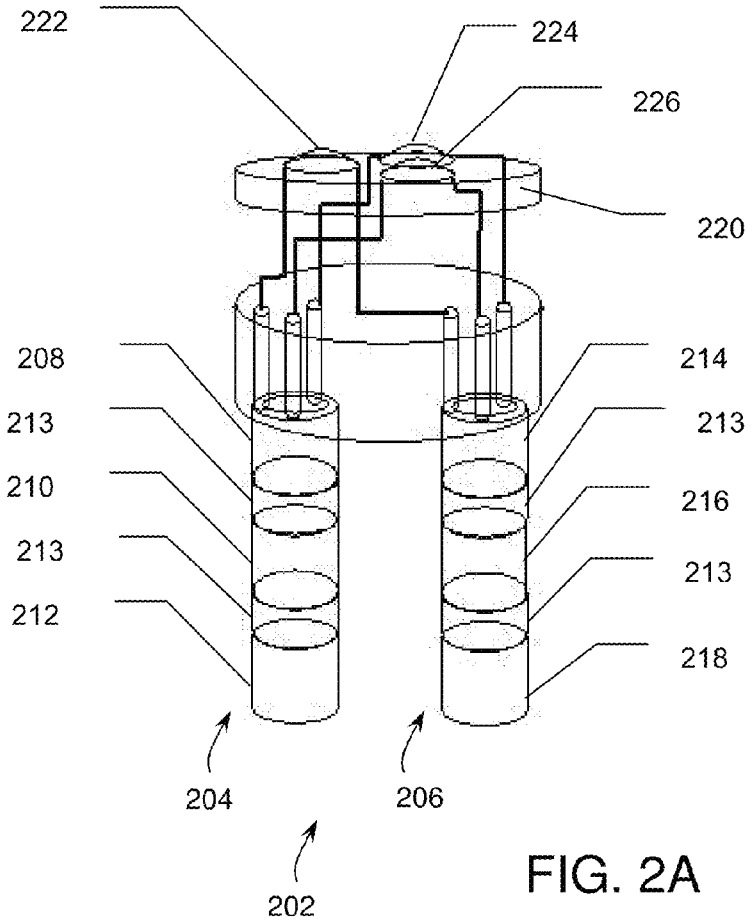
FIG. 2A is a perspective view of an LED lamp pin, in accordance with an embodiment of the present invention.

FIG. 2 is a perspective view of an LED lamp contact 202, in accordance with an embodiment of the present invention. The LED lamp contact 202 includes a positive lamp pin 204 and negative lamp pin 206. The positive lamp pin 204 includes a first positive section 208, a second positive section 210, and a third positive section 212. Multiple insulators 213 separate the different sections from each other, including an insulator 213 between the first positive section 208 and the second positive section 210, and an insulator 213 between the second positive section 210 and the third positive section 212. The negative lamp pin 206 includes a first negative section 214, a second negative section 216, and a third negative section 218. An insulator 213 also separates each of the negative sections on the negative lamp pin 206. The insulators may be any suitable insulating material. Also, the insulating material may also be air or space separating each of the contact sections so that the LED lamp can operate. Each of the positive lamp pin 204 and the negative lamp pin 206 is coupled to multi spectrum LED 220 or other LED chip. As the multi spectrum LED 220 includes a first spectrum LED 222, a second spectrum LED 224 and a third spectrum LED 226, each section of the positive lamp pin 204 and the negative lamp pin 206 is configured to control a corresponding spectrum LED of multi spectrum LED 220. The LED lamp contact 202 and the multi spectrum LED 220 may be included within the LED lamp. Therefore, the LED lamp may be inserted into a corresponding lamp sockets such that independent control of the first spectrum LED 222, the second spectrum LED 224, and the third spectrum LED 226 can be provided by the lighting control system 102.

Figure 2B:
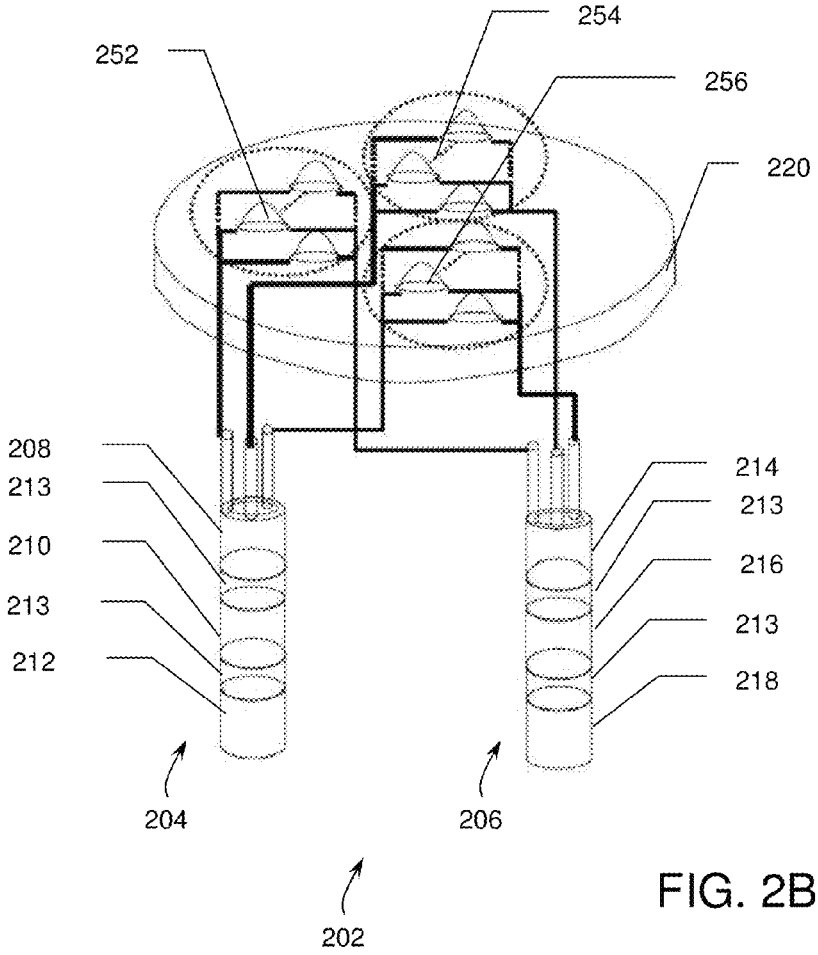
FIG. 2B is a perspective view of an LED lamp pin and LED groups, in accordance with an embodiment of the present invention.

FIG. 2B is a perspective view of an LED lamp pin and LED groups, in accordance with an embodiment of the present invention. The LED lamp contact 202 is similar to that described and illustrated with reference to FIG. 2A, including the positive lamp pin 204 and negative lamp pin 206. In the embodiment illustrated in FIG. 2B, the multi spectrum LED 250 includes a first group of LED 252, a second group of LED 254, and a third group LED 256, each section of the positive lamp pin 204 and the negative lamp pin 206 is configured to control a corresponding group of LED of multi spectrum LED 220. Therefore, multiple LED may be used for a predetermined spectrum of light, and the multiple LED may be simultaneously controlled using embodiments of the present invention. In the illustrated embodiment, while each of the groups of LED includes three LED, any suitable number of LED may be included in each one of the groups.

Figure 3:
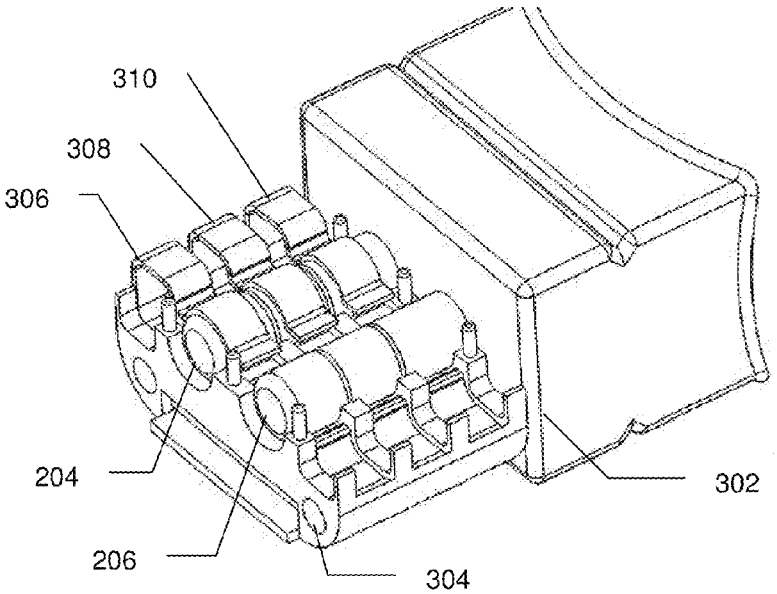
FIG. 3 is a perspective view of a lamp socket and lamp pin, in accordance with an embodiment of the present invention.

FIG. 3 is a perspective view of a lamp socket 304 and lamp contact 202, in accordance with an embodiment of the present invention. The lamp plug 302 is connected to the positive lamp pin 204 and the negative lamp pin 206. The positive lamp pin 204 and the negative lamp pin 206 of the lamp plug 302 are coupled with the LED lamp socket 304. The LED lamp socket 304 includes multiple, independent contact rows, including a first contact row 306, a second contact row 308, and a third contact row 310. During engagement of the lamp plug 302 with the LED lamp socket 304, each section of the positive and negative lamp pins 204, 206 is electrically coupled with a corresponding row of the LED lamp socket 304. Therefore, the first positive and negative sections 208, 214 are electrically coupled with the first contact row 306, the second positive and negative sections 210, 216 are electrically coupled with the second contact row 308, and the third positive and negative sections 212, 218 are electrically coupled with the third contact row 310.

Figure 4:
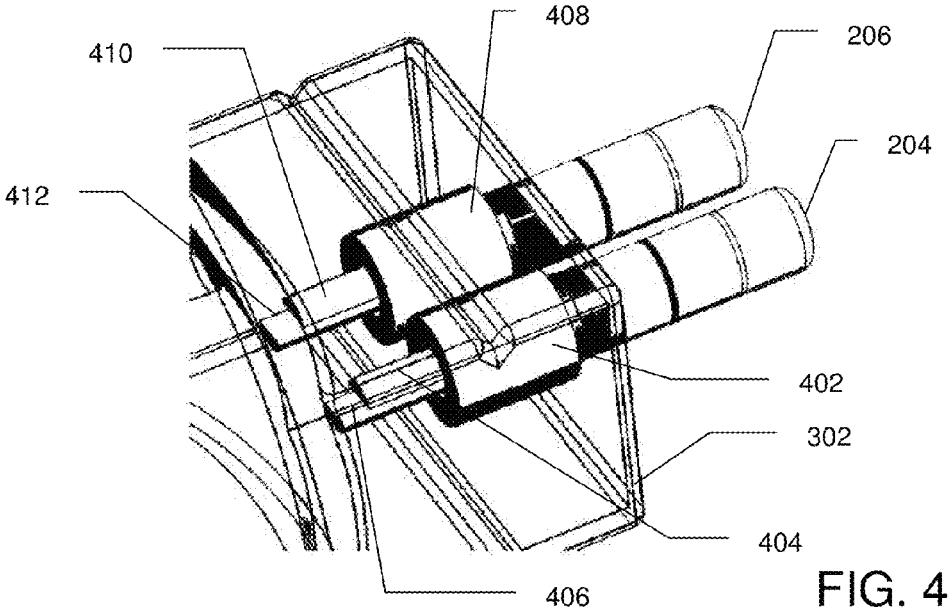
FIG. 4 is a partial cutaway view of a lamp plug showing the lamp pin structure, in accordance with an embodiment of the present invention.

FIG. 4 is a partial cutaway view of a lamp plug showing the lamp pin structure, in accordance with an embodiment of the present invention. The lamp plug 302 and the positive and negative lamp pins 204, 206 may be seen. Also seen in the partial cutaway view shown in FIG. 4 are an internal portion of the positive lamp pin 204 and an internal portion of the negative lamp pin 206. According to the illustrated embodiment, the internal portion includes longitudinally aligned sections insulated from each other. The longitudinally aligned sections may each correspond to one of the spectrums of the multi spectrum LED. For example, a first internal positive contact 402, a second internal positive contact 404, and a third internal positive contact 406 are shown. Also, a first internal negative contact 408, a second internal negative contact 410, and a third internal negative contact 412 are shown.

Figure 5:
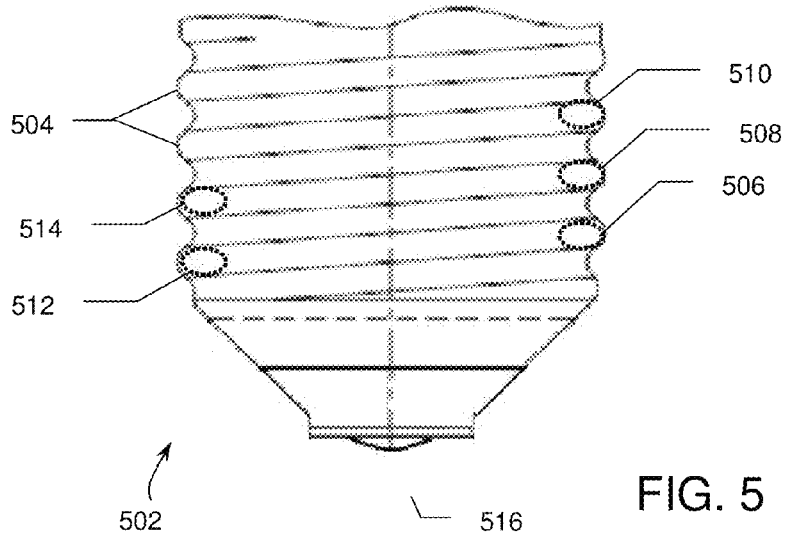
FIG. 5 is side schematic view of a screw type lamp cap, in accordance with an embodiment of the present invention.

FIG. 5 is side schematic view of a screw type lamp cap, in accordance with an embodiment of the present invention. The screw type lamp cap 502 is a lamp contact including a circular thread 504 around the lamp cap 502. Contacts for different spectrums of the multi spectrum LED are positioned in different levels of the thread 504. In the illustrated embodiment, a first red contact 506 is positioned along the same side of the lamp cap 502 as a second positive contact 508 and a third positive contact 510. On generally the opposite of the lamp cap 502, a first negative contact 512 and a second negative contact 514 are positioned on the thread 504. A third negative contact 516 may be positioned at an end of the lamp cap 502. The various contacts, however, may be placed in other locations according desired applications. In one embodiment, the contacts in the screw type lamp cap may be configured in the form of discrete studs disposed onto the screw type lamp cap, the screw type lamp cap being comprised on insulating material. However, the contact may also take any other shape or configuration suitable for use with embodiments of the present invention.

Figure 6:
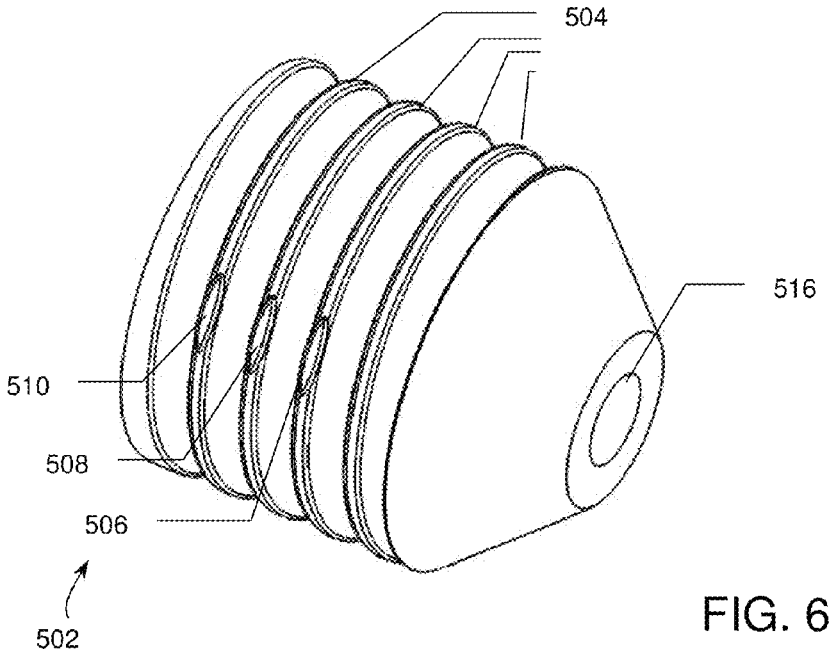
FIG. 6 is a perspective view of a screw type lamp cap, in accordance with an embodiment of the present invention.

FIG. 6 is a perspective view of the screw type lamp cap 502, in accordance with an embodiment of the present invention. In the perspective view, the shape the lamp cap 502 may be seen. Also, the configuration of the thread 504 may also be seen running around the outer portion of the lamp cap 502. The first positive contact 506, the second positive contact 508, and the third positive contact 510 are shown on different levels of the thread 504.

Figure 7:
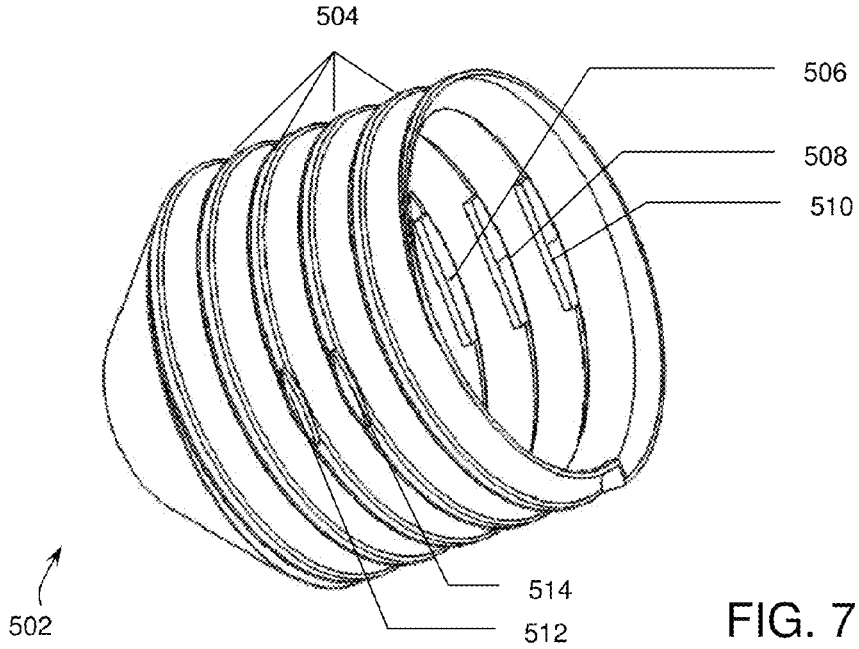
FIG. 7 is an internal perspective view of the screw type lamp cap shown in FIG. 6, in accordance with an embodiment of the present invention.

FIG. 7 is an internal perspective view of the screw type lamp cap 502 shown in FIG. 6, in accordance with an embodiment of the present invention. The inside of the lamp cap 502 shows the first positive contact 506, the second positive contact 508, and the third positive contact 510. Therefore, an electrical connection can be made from these contacts from the inside of the lamp cap 502 to the multi spectrum LED that is used with the attached lamp cap 502 to form an LED lamp.

Figure 8:
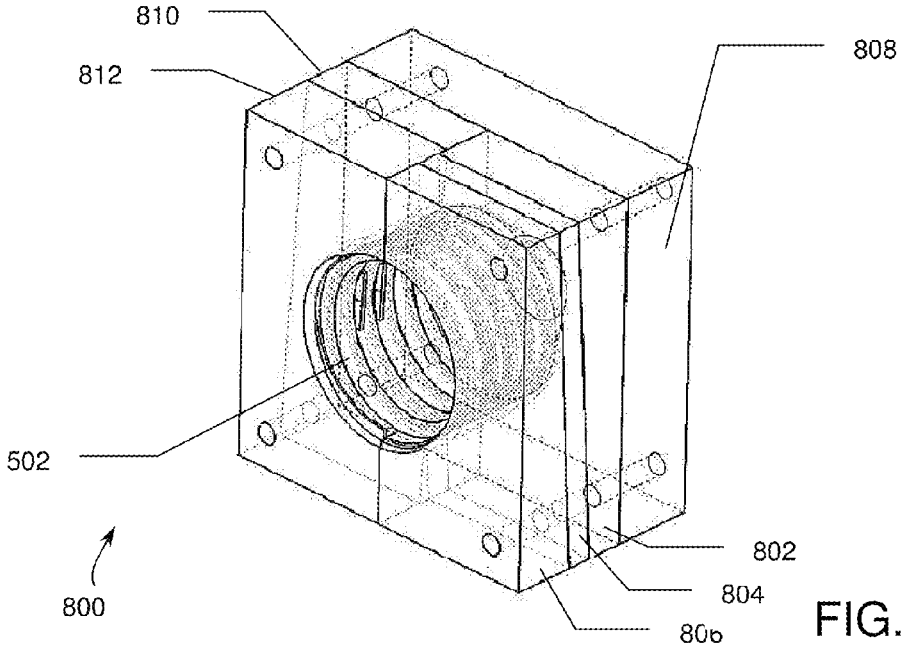
FIG. 8 is a perspective view of a screw type lamp socket and lamp cap, in accordance with an embodiment of the present invention.

FIG. 8 is a perspective view of a screw type lamp socket 800 and lamp cap 502, in accordance with an embodiment of the present invention. The screw type lamp socket 800 includes multiple sections, each section configured to form an electrical connection with a corresponding contact of the lamp cap 502. In the illustrated embodiment, the screw type lamp socket 800 includes a first positive section 802, a second positive section 804, and a third positive section 806. The screw type lamp socket 800 also includes a first negative section 808, a second negative section 810, and a third negative section 812.

Figure 9:
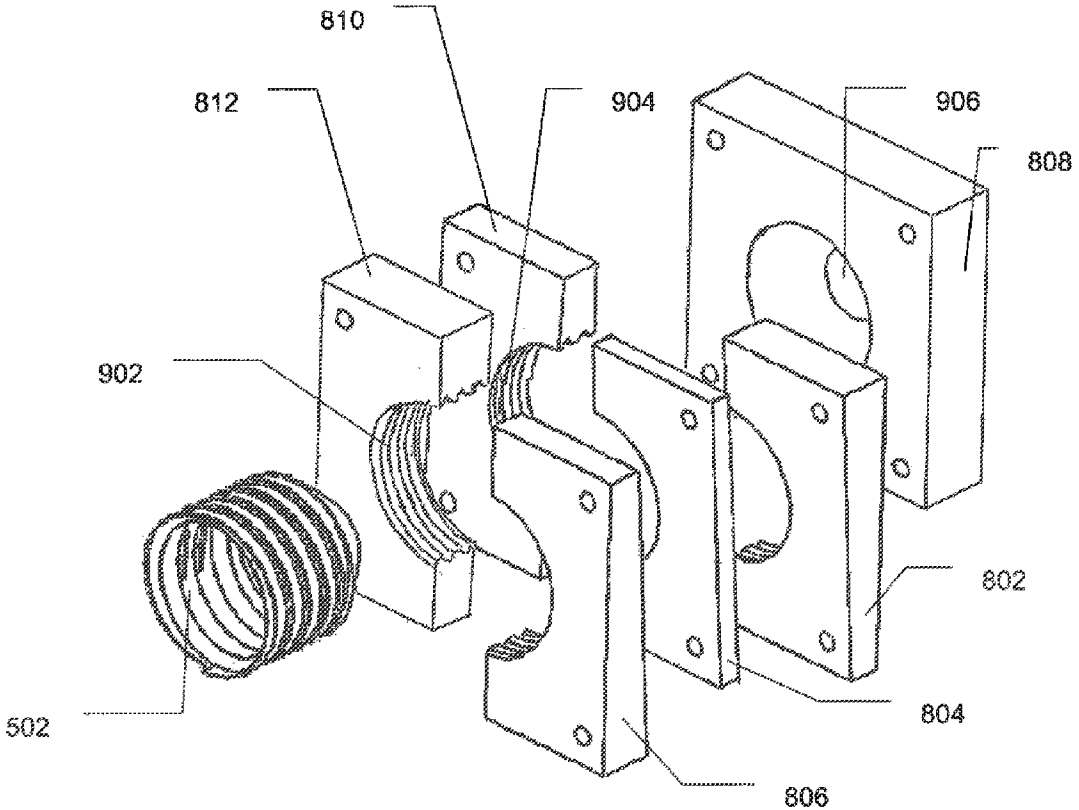
FIG. 9 is an exploded perspective view of a screw type lamp socket and lamp cap shown in FIG. 8, in accordance with an embodiment of the present invention.

FIG. 9 is an exploded perspective view of a screw type lamp socket 800 and lamp cap 502 shown in FIG. 8, in accordance with an embodiment of the present invention. In the exported prospective view, the different sections of the screw type lamp socket 800 may be seen. Also visible in this view, the third blue section 812 includes a third negative socket contact 902, the second negative section 810 includes a second negative socket contact 904, and the first negative section 808 includes a first negative red socket contact 906. While not visible in the prospective view, the first positive section 802, the second positive section 804, and a third positive section 806 similarly have socket contacts for making electrical connections with a corresponding contact of the lamp cap 502.

One feature of embodiments of the present invention are that both controllable multi spectrum LED lamps and conventional lamps may both be used with the lighting control system. According to one embodiment of the present invention, the lighting control system includes a lamp detection system to detect whether a controllable lamp or a conventional lamp is located in one of the lamp sockets of the system. According to another embodiment, lamps may be removably, electrically connected to a lighting system, such as in plug and play type lighting system. In this embodiment, both controllable lamps and conventional lamps may be used with embodiments of the present invention. The detection system may differentiate between controllable and non-controllable lamps.

Figure 10:
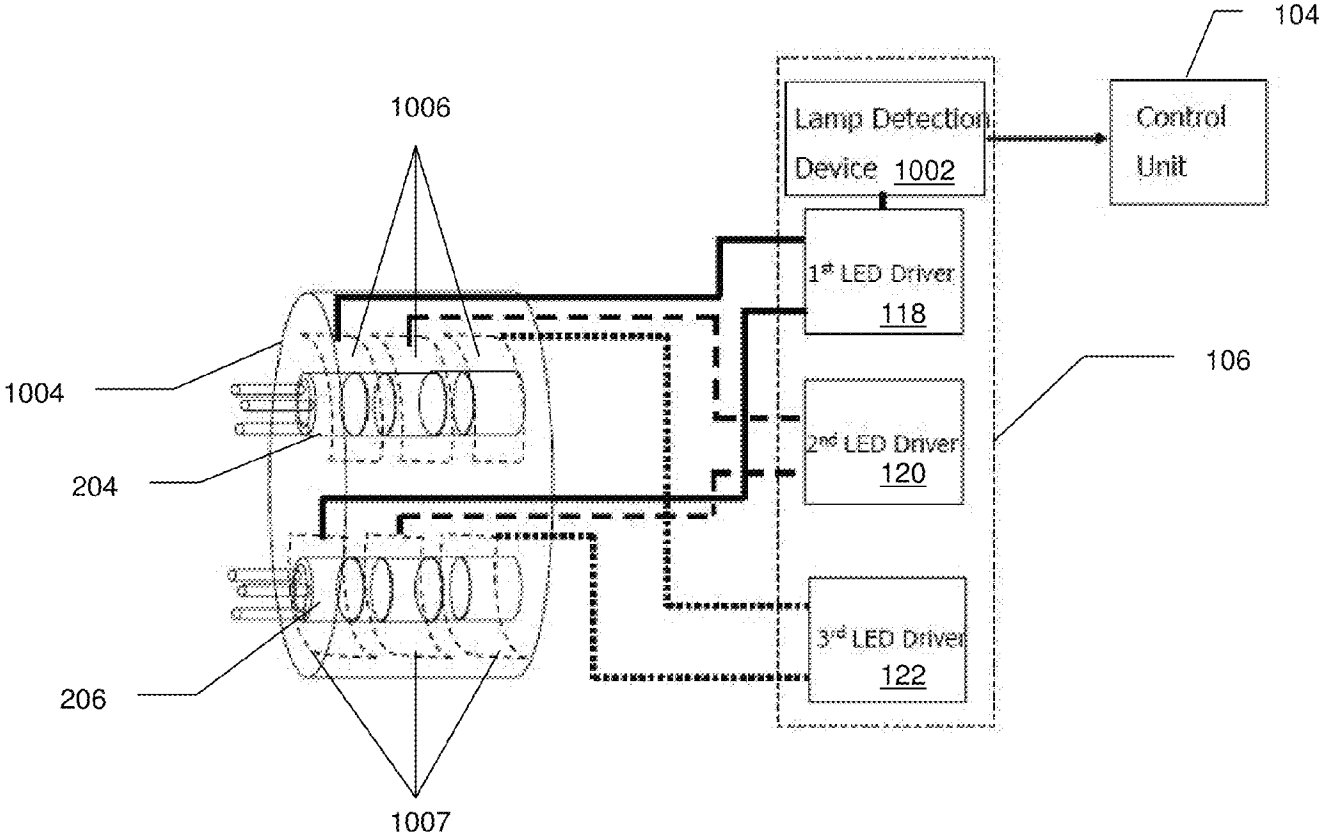
FIG. 10 is a block diagram of a lamp detection system, in accordance with a second embodiment of the present invention.

FIG. 10 is a block diagram of a lamp detection system, in accordance with a second embodiment of the present invention. The LED driver unit 106 includes the first LED driver 118, the second LED driver 120, and the third LED driver 122. The LED driver unit also includes a lamp detection device 1002 that detects the presence of a lamp in the lamp socket 1004. Each of the first LED driver 118, the second LED driver 120, and the third LED drivers 122 are electrically connected to one of the positive metal contacts 1006 and one of the negative metal contacts 1007. Each of the positive metal contacts 1006 is positioned to make electrical contact with a positive section of the LED lamp contact 202, and each of the negative metal contacts 1007 is positioned to make electrical contact with a negative section of the LED lamp contact 202. Any contact between one of the positive metal contacts 1006 and a corresponding one of the negative metal contacts 1007 with the LED lamp contact 202 will result in the lamp detection device 1002 to transmit a signal to the control unit 104 that a lamp has been detected.

Figure 11:
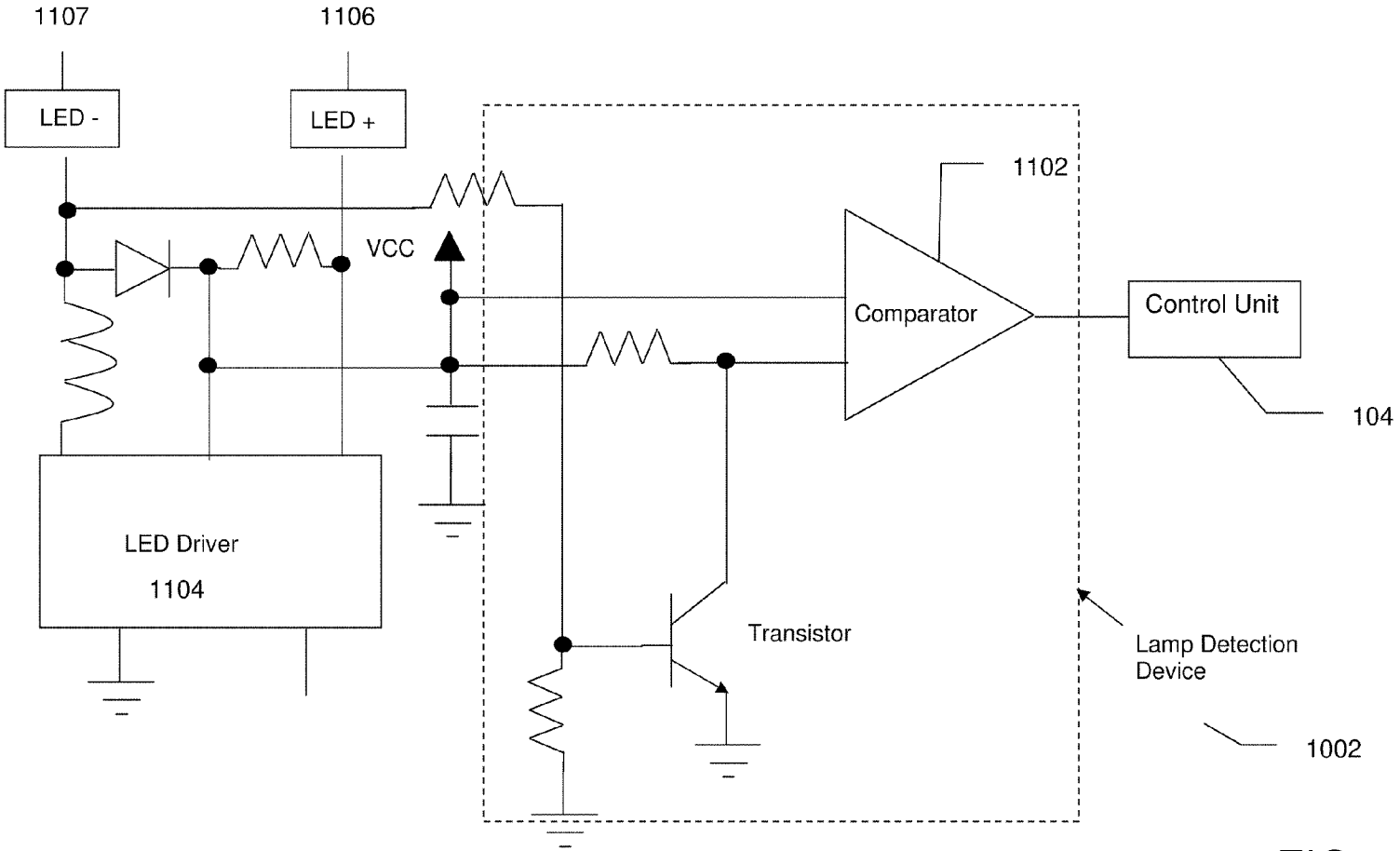
FIG. 11 is a circuit diagram of a lamp detection system, in accordance with a second embodiment of the present invention.

FIG. 11 is a circuit diagram of a lamp detection system, in accordance with a second embodiment of the present invention. The lamp detection device 1002 includes a comparator 1102 and one of the LED drivers 1104. The LED driver 1104 is electrically coupled to the positive metal contact 1106 and the negative metal contact 1107. The lamp detection device 1002 is configured to detect an electrical current through the positive metal contact 1106 and the negative metal contact 1107, thereby resulting in an affirmative detection signal to be sent to the control unit 104. The circuit diagram shown in FIG. 11 is only one example circuit layout of the lamp detection device 1102 suitable for use with embodiment of the person invention. Other lamp detection circuits or components may also be used.

Figure 12:
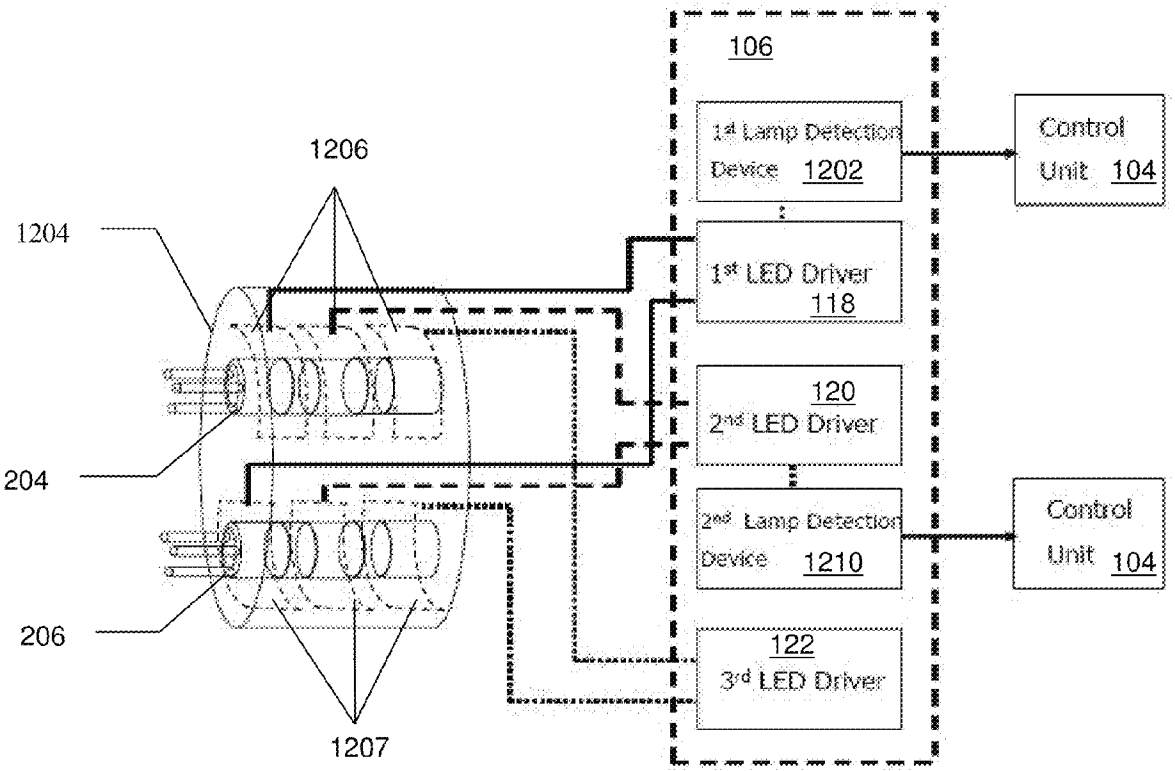
FIG. 12 is a block diagram of a lamp type detection system, in accordance with a second embodiment of the present invention.

FIG. 12 is a block diagram of a lamp type detection system, in accordance with a second embodiment of the present invention. The LED driver unit 106 includes the first LED driver 118, the second LED driver 120, and the third LED driver 122. The LED driver unit 106 also includes a first lamp detection device 1202 and a second lamp detection device 1210 that that are configured to detect the presence of a controllable lamp in the lamp socket 1204. Each of the first LED driver 118, the seconded LED driver 120, and the third LED driver 122 are electrically connected to a positive metal contact 1206 and a negative metal contact 1207. Each of the positive metal contacts 1206 is positioned to make electrical contact with a corresponding section of the positive LED lamp pin 204. A set of negative metal contact 1207 are positioned to make electrical contact with a corresponding section of the negative lamp pin 206. Any contact between one of the positive and negative metal contacts 1206, 1207 with a first predetermined section of the LED lamp contact 202 will result in the first lamp detection device 1202 to transmit an appropriate signal to the control unit 104. A second lamp detection device 1210 is in electrical communication with a second LED driver. In the illustrated example, the second lamp detection device 1210 is electrically coupled to the second LED driver 120. Any contact between one of the positive and negative metal contacts 1206, 1207 with a second predetermined section of the LED lamp contact 202 will result in the first lamp detection device 1202 to transmit an appropriate signal to the control unit 104.

FIG. 13 is a logic table illustrating decision logic for the lamp type detection system illustrated in FIGS. 11 and 12, in accordance with a second embodiment of the present invention. Control signal CTL1 corresponds to a signal detected and transmitted by the first LED driver 118 and control signal CTL2 corresponds to a signal detected and transmitted by the second LED driver 120. Depending on the combination of control signals CTL1 and CTL2 and the signal of the first lamp detection device 1202 and the second lamp detection device 1210, the system can detect both the presence of a lamp, the type of lamp, and the number of colors of the lamp detected, if the lamp is a color LED lamp, according to the logic table illustrated in FIG. 13. Other logic decisions may also be used according to the particular implementation being used.

Figure 14:
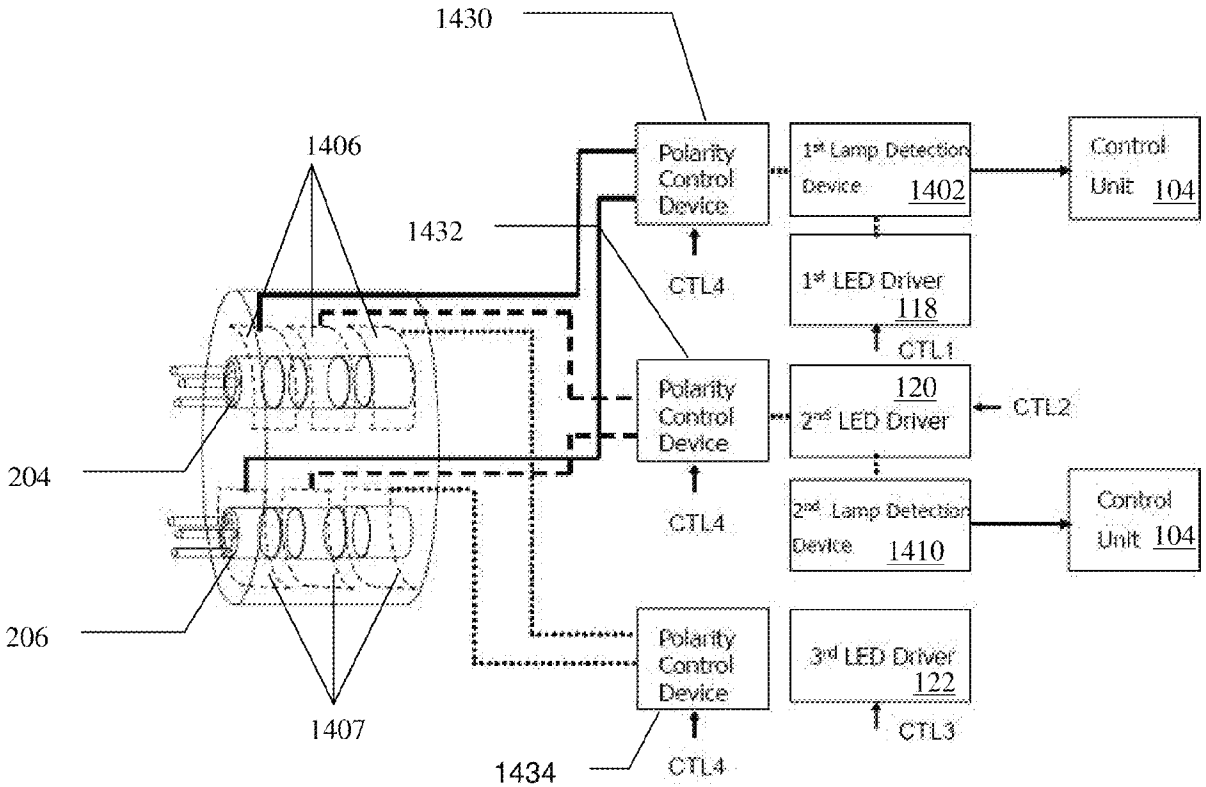
FIG. 14 is a block diagram of a polarity detection and control system, in accordance with a second embodiment of the present invention.

FIG. 14 is a block diagram of a polarity detection and control system, in accordance with a second embodiment of the present invention. The polarity detection and control system further includes a first polarity control device 1430 electrically coupled between the first LED driver 118 and the metal contacts 1406, 1407. The polarity detection and control system also includes a second polarity control device 1432 similarly positioned between the second LED driver 120 and the metal contacts 1406, 1407 and a third polarity control device 1434 similarly positioned between the third LED driver 122 and the metal contacts 1406, 1407.

Figure 15:
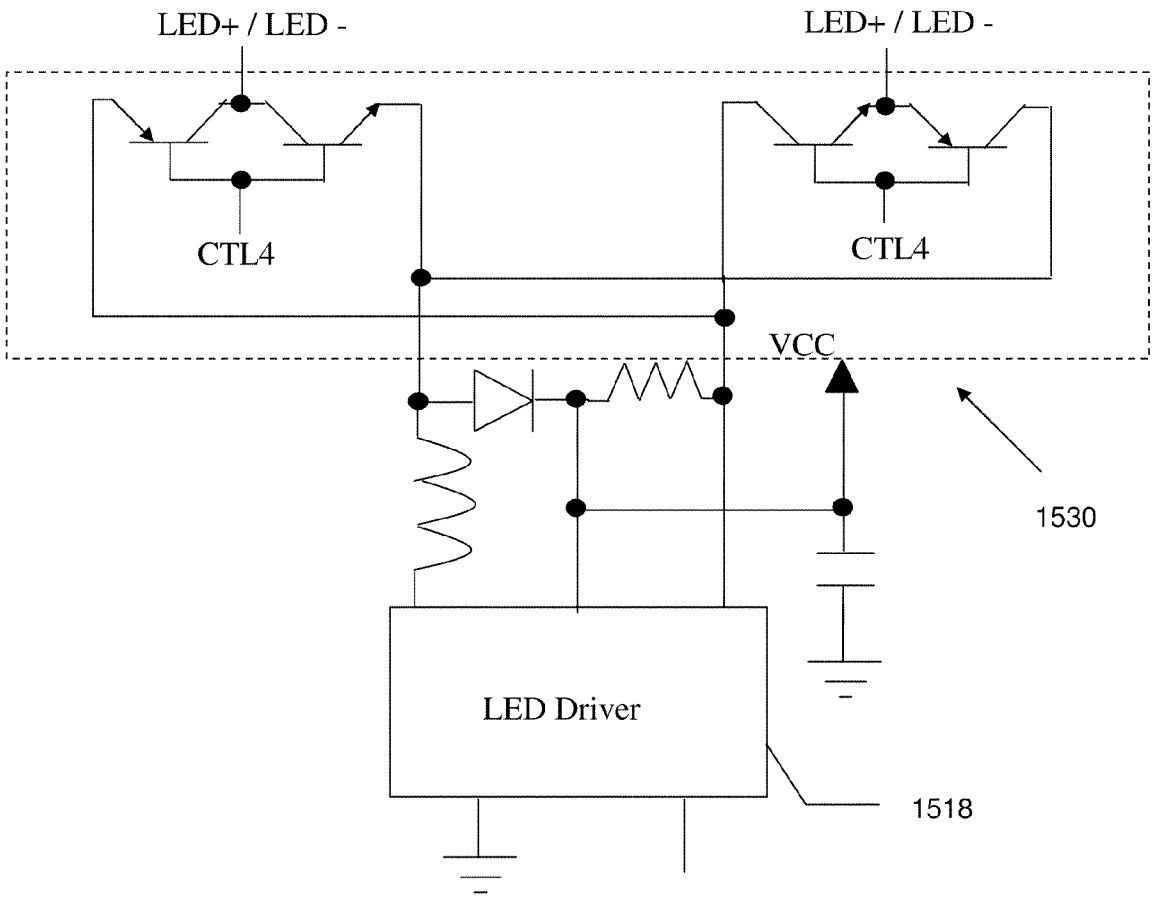
FIG. 15 is a circuit diagram of the polarity detection and control system shown in FIG. 14, in accordance with a second embodiment of the present invention.

FIG. 15 is a circuit diagram of the polarity detection and control system shown in FIG. 14, in accordance with a second embodiment of the present invention. The circuit diagram includes one of the polarity control devices 1530 and one of the LED drivers 1518.

While the invention has been particularly shown and described with reference to the illustrated embodiments, those skilled in the art will understand that changes in form and detail may be made without departing from the spirit and scope of the invention. For example, while certain configurations of lamp pins, lamp plugs, lamp caps, and lamp sockets have been illustrated and described, embodiments of the present invention are not limited to these example configurations. In addition to the lamp pin type examples illustrated in the figures, the lamps and lamp pins and plugs may be any suitable type, including but not limited to the following pin types: GU5.3, GU10, GX5.3, GX10, T5, T6, T8, T9, T10, T12, and screw type E14, E26, and E27. Accordingly, LED lamps and luminaries may occupy different configurations without departing from the scope of the present invention. Also, while certain connections and positioning of contact components are shown in the illustrated embodiments, these connections may be altered and varied according to the particular implementations of the system. Additionally, while example control systems circuits have been illustrated and described, other suitable control systems may be used.

While the illustrated lamp pins are and lamp connections are configured to transmit three different control signals, any number of signals can be implemented using embodiments of the present invention, depending on the particular implementation. Therefore, two control signals may also be transmitted, or four or more control signals may also be transmitted.

Accordingly, the above description is intended to provide example embodiments of the present invention, and the scope of the present invention is not to be limited by the specific examples provided.

What is claimed is:

1. A controllable color light emitting diode (LED) lamp comprising:

two or more light emitting elements, a first light emitting element of the two or more light emitting elements configured to emit a first light spectrum and a second light emitting element of the two or more light emitting elements configured to emit a second light spectrum, each of the two or more light emitting elements including an anode and a cathode; and a positive electrical contact assembly and a negative electrical contact assembly, each of the positive electrical contact assembly and the negative electrical contact assembly including at least a first contact section and a second contact section, each of the first contact sections and the second contact sections are separated by insulating material, wherein the first contact section of the positive electrical contact assembly is electrically connected to the anode of the first light emitting element and the second contact section of the positive electrical contact assembly is electrically connected to the anode of the second light emitting element, wherein the first contact section of the negative electrical contact assembly is electrically connected to the cathode of the first light emitting element and the second contact section of the negative electrical contact assembly is electrically connected to the cathode of the second light emitting element, and wherein the first and second contact sections and the insulating material of the positive contact assembly are aligned in a rod-like configuration along a first axis, and the first and second contact sections and the insulating material of the negative contact assembly are aligned in a rod-like configuration along a second axis.

2. The controllable color LED lamp of claim 1, wherein the insulating material of each contact assembly is abutted by both the first contact section and the second contact section of each contact assembly.

3. The controllable color LED lamp of claim 1, wherein the positive electrical contact assembly has a socket end configured for electrical contact with a lamp socket and a lamp end electrically connected to the two or more light emitting elements, and the negative electrical contact assembly has a socket end configured for electrical contact with a lamp socket and a lamp end electrically connected to the two or more light emitting elements.

4. The controllable color LED lamp of claim 1, further comprising:

a third light emitting element of the two or more light emitting elements configured to emit a third light spectrum, the third light emitting element including an anode and a cathode, and wherein the positive electrical contact assembly and the negative electrical contact assembly each further includes a third contact section separated from the first and second contact sections, wherein the third contact section of the positive electrical contact is electrically connected to the anode of the third light emitting element, and wherein the third contact section of the negative electrical contact is electrically connected to the cathode of the third light emitting element.

5. The controllable color LED lamp of claim 4, wherein the first, second, and third contact sections and the insulating materials of the positive contact assembly are aligned in a rod configuration along a first axis, and the first, second, and third contact sections and the insulating materials of the negative contact assembly are aligned in a rod configuration along a second axis, and a first one of the insulating materials of each contact assembly is abutted by both the first contact section and the second contact section of each contact assembly, and a second one of the insulating materials of each contact assembly is abutted by both the second contact section and the third contact section of each contact assembly.

6. The controllable color LED lamp of claim 4, wherein the positive electrical contact assembly has a socket end configured for electrical contact with a lamp socket and a lamp end electrically connected to the two or more light emitting elements, and the negative electrical contact assembly has a socket end configured for electrical contact with a lamp socket and a lamp end electrically connected to the two or more light emitting elements.

7. A controllable color light emitting diode (LED) lamp comprising:

two or more light emitting elements, a first light emitting element of the two or more light emitting elements configured to emit a first light spectrum and a second light emitting element of the two or more light emitting elements configured to emit a second light spectrum, each of the two or more light emitting elements including an anode and a cathode; and a positive electrical contact assembly and a negative electrical contact assembly, each of the positive electrical contact assembly and the negative electrical contact assembly including at least a first contact section and a second contact section, each of the first contact sections and the second contact sections are separated by insulating material, wherein the first contact section of the positive electrical contact assembly is electrically connected to the anode of the first light emitting element and the second contact section of the positive electrical contact assembly is electrically connected to the anode of the second light emitting element, wherein the first contact section of the negative electrical contact assembly is electrically connected to the cathode of the first light emitting element and the second contact section of the negative electrical contact assembly is electrically connected to the cathode of the second light emitting element, and wherein each of the first and second contact sections of the positive and negative contact assemblies are in the form of discrete studs disposed onto a screw type lamp cap made of insulating material.

8. The controllable color LED lamp of claim 7, wherein each of the first contact section and the second contact section includes an outer portion and an inner portion, wherein the outer portion is configured for electrical contact by a lamp socket and the inner portion is electrically connected to one of the two or more light emitting elements.

9. The controllable color LED lamp of claim 7, wherein each of the positive contact and negative contact assemblies further comprise of third contact section, in the form of a discrete stud disposed onto the screw type lamp cap made of insulating material.

10. The controllable color LED lamp of claim 9, wherein the each of the first contact section, the second contact section, and the third contact section of the positive electrical contact is positioned along a first location on the screw type contact, and each of the first contact section, the second contact section, and the third contact section of the negative electrical contact is positioned along a second location on the screw type contact.

11. The controllable color LED lamp of claim 10, wherein the first location is on an opposing side of the lamp from the second location.

12. A controllable color light emitting diode (LED) lamp comprising:

two or more light emitting elements, a first light emitting element of the two or more light emitting elements configured to emit a first light spectrum and a second light emitting element of the two or more light emitting elements configured to emit a second light spectrum, each of the two or more light emitting elements including an anode and a cathode;

a positive electrical contact assembly and a negative electrical contact assembly, each of the positive electrical contact assembly and the negative electrical contact assembly including at least a first contact section and a second contact section, each of the first contact sections and the second contact sections are separated by insulating material;

a control unit configured to receive lighting control instructions and transmit lighting control signals to the LED lamp; and an LED driver unit configured to provide electric control of the LED lamp by delivering the lighting control signals and by detecting the presence of the LED lamp electrically coupled to a lamp socket;

wherein the first contact section of the positive electrical contact assembly is electrically connected to the anode of the first light emitting element and the second contact section of the positive electrical contact assembly is electrically connected to the anode of the second light emitting element, wherein the first contact section of the negative electrical contact assembly is electrically connected to the cathode of the first light emitting element and the second contact section of the negative electrical contact assembly is electrically connected to the cathode of the second light emitting element.

13. The controllable color LED lamp of claim 12, wherein each of the lighting control signals is configured to control one light emitting element, wherein a first one of the lighting control signal is configured to control the first light emitting element and the second lighting control signal is configured to control the second light emitting element.

14. The controllable color LED lamp of claim 12, further comprising an LED lamp socket configured to receive the LED lamp, wherein the LED driver unit is configured to control the LED lamp socket.

15. The controllable color LED lamp of claim 12, wherein the detection device is configured to determine the number of light spectrum light emitting elements that are included on the LED lamp to differentiate the polarity of the LED lamp.

16. The controllable color LED lamp of claim 12, wherein the detection device includes a polarity detection device.

17. The controllable color LED lamp of claim 12, wherein the LED driver unit comprises:

one or more LED drivers each configured to deliver one or more independent lighting control signals; and one or more detection devices configured to detect the presence of a LED lamp electrically coupled to a lamp socket.

* * * * *